United States Patent [19]

Maruyama et al.

[11] 4,402,653

[45] Sep. 6, 1983

[54] ROTARY COMPRESSOR

[75] Inventors: Teruo Maruyama, Neyagawa; Masao Hara, Kyoto; Yoshiyuki Morikawa, Otsu, all of Japan

[73] Assignee: Matsushita Electric Industrial Co., Ltd., Kadoma, Japan

[21] Appl. No.: 228,805

[22] Filed: Jan. 27, 1981

[30] Foreign Application Priority Data

Jan. 29, 1980 [JP] Japan ..... 55-9844

[51] Int. Cl.[3] ..... F04C 29/02

[52] U.S. Cl. ..... 418/76; 418/79; 418/93

[58] Field of Search ..... 418/76, 79, 99, 93, 418/269, 268

[56] References Cited

U.S. PATENT DOCUMENTS

| | | | |
|---|---|---|---|
| 3,007,419 | 11/1961 | Burt | 418/79 |
| 3,988,080 | 10/1976 | Takada | 418/76 |
| 4,025,242 | 5/1977 | Webb | 418/99 |
| 4,071,306 | 1/1978 | Calabretta | 418/93 |
| 4,209,287 | 6/1980 | Takada | 418/93 |
| 4,224,014 | 9/1980 | Glanvall | 418/79 |
| 4,231,727 | 11/1980 | Buchholz et al. | 418/76 |

*Primary Examiner*—Ira S. Lazarus

*Attorney, Agent, or Firm*—Wenderoth, Lind & Ponack

[57] ABSTRACT

A rotary compressor comprises an open-ended cylinder having its open ends closed by end plates and an eccentrically rotatable rotor housed inside the cylinder. A hydrodynamic seal is provided on either the rotor or each of the end plates for minimizing any possible unwanted leakage of lubricant oil.

20 Claims, 9 Drawing Figures

ROTARY COMPRESSOR

BACKGROUND OF THE INVENTION

The present invention generally relates to a rotary compressor and, more particularly, to a rotary compressor capable of exhibiting a relatively high working efficiency achieved by minimizing the leakage of a fluid coolant between the rotor and the end plate adjacent the rotor.

Problems associated with the coolant leakage occurring in the prior art rotary compressor used in an automobile air conditioner will first be discussed with particular reference to FIGS. 1 and 2 of the accompanying drawings which show the prior art rotary compressor of a type utilizing sliding vanes and a cross-sectional view thereof, respectively.

The rotary compressor of a type utilizing sliding vanes has come to be used in a power plant of the automobile air conditioner because of its numerous features, lightness in weight, efficiency in performance and low noise level. As shown in FIG. 1, the rotary compressor generally comprises a hollow cylinder 100 having a vane chamber 101 defined therein between a pair of opposite end plates 102 (see FIG. 2) secured to the respective ends of the cylinder 100, a rotor 103 accommodated within the cylinder 100 for eccentric rotation with respect to the longitudinal axis of the cylinder 100, and a plurality of, for example, four, vanes 105 accommodated partially in respective grooves 104, defined in the rotor 103, for movement between projected and retracted positions, each of the vanes 104 being moved to the projected position under the influence of a centrifugal force developed during the eccentric rotation of the rotor 103 with its free end held slidingly in contact with the cylinder wall defining the chamber 101.

However, when the rotary compressor of the construction described above is used in an automobile air conditioner, it has been found that the centrifugal force developed during the eccentric rotation of the rotor does not sufficiently work on each of the vanes 105 to move the latter between the projected and retracted positions smoothly. The reason therefor is that, since the rate of rotation decreases to 800 to 100 rpm when and so long as the automobile engine is operated under idling, the centrifugal force, the magnitude of which is proportional to the square of the rate of rotation, decreases to such an extent as to become insufficient to move the vanes 105.

Where each of the grooves 104 is so eccentrically formed in the rotor 103 that a respective vane of relatively great in length can be utilized, a component of the centrifugal force acting laterally of each vane 105, or a Coriolis force, acts as a frictional force to hamper a smooth movement of the respective vane 105 and, in the worst case, the tip of each of the vanes 105 may depart from the cylinder wall defining the chamber 101.

Moreover, since a pneumatic pressure inside a closed space defined between each groove 104 and the internal end of the corresponding vane 105 varies constantly according to changes in volume of the closed space and since the volume of the closed space located rearwardly of the corresponding vane 105 abruptly increases adjacent the suction port, a negative pressure is developed to restrain outward projection of the corresponding vane 105 relative to the rotor 103. Repeated movement of the vanes 105 between the projected and retracted positions without the tips held slidingly in contact with the cylinder wall, if it occurs, constitutes a major cause of noises generated by the rotary compressor.

In order to avoid the above described disadvantage, as shown in FIG. 2, a method has been employed to ensure a smooth movement of each vane between the projected and retracted positions during the eccentric rotation of the rotor 103. According to this method, the end plate 102 is formed with a substantially ring-shaped connecting groove 106 through which the spaces which are defined between the internal ends of the grooves 104 and the internal ends of the vanes 105 accommodated slidably in such grooves 104 communicate with each other, so that highly pressurized oil coupled to the discharge pressure at the discharge port can be supplied into such spaces through the connecting groove 106 as shown in FIG. 2. As shown, since the highly pressurized oil 107 acts on the internal ends of the respective vanes 105, the sliding contact of the tip of each vane 105 with the cylinder wall, which tends to be destroyed adjacent the suction area, can be ensured. However, even the construction shown in FIG. 2 involves such a disadvantage as to reduce the compression efficiency of the rotary compressor.

Specifically, since the oil 107 is pressurized by the action of a coolant, for example, furonic gas, the temperature of which has been increased by the high pressure on the discharge side, a fluid medium supplied to the connecting groove 106 is a mixture of the oil with the coolant, this mixture being supplied to the connecting groove 106 through a communicating port 108. The mixture of the oil with the coolant leaks, as shown by the arrow A in FIG. 2, from the connecting groove 106 radially outwardly into the vane chambers 101, thereby bringing about reduction in volume efficiency during low speed rotation.

In order to avoid the disadvantage inherent in the rotary compressor of the construction shown in FIG. 2, it can be contemplated to minimize the gap between the rotor 103 and the end plate adjacent the rotor, that is, minimize the gap shown by $\delta$ in FIG. 3, so that the resistance to the viscous flow of the leaking fluid can be increased. However, since the rotor 103, the vanes 105 and the end plate 102 are all made of either aluminum or iron material, they tend to burn easily by the effect of metal-to-metal contact which occurs as a result of thermal expansion of these component parts.

Accordingly, the maximum tolerable size of the gap according to the prior art is limited to the range of 30 to 40$\mu$.

When an oil of relatively high viscosity is employed, the radial leakage of the fluid medium discussed above can advantageously be minimized or substantially eliminated. Although this measure may bring about an increase of the viscous load torque between the rotor 103 and the end plate 102, an increase of the sliding resistance of the vanes 105 and the consequent increase of the volume efficiency, an adverse effect is also brought about in that the mechanical efficiency of the rotary compressor is reduced.

Although the problems evoked by the prior art rotary compressors when the latter are used in the automobile air-conditioner have been discussed, similar problems, particularly those associated with the reduced compression efficiency, equally apply even when the prior art rotary compressors are used in devices other than automobile air-conditioners. By way of example, the prior art rotary compressors, irrespective of how they are used, involve a common problem in the presence of a leakage of fluid, in a direction shown by the arrow B in FIG. 2, from one vane chamber 101 under high pressure to the next adjacent vane chamber 101 under low pressure across the rotor 103.

SUMMARY OF THE INVENTION

Accordingly, the present invention has been developed with a view to substantially eliminating the disadvantages and inconveniences inherent in the prior art rotary compressors and has for its essential object to provide an improved rotary compressor utilizing sliding vanes which brings about the following advantages:

1. Since the internal leakage of the coolant is minimized or substantially eliminated, the improved rotary compressor operates at a high efficiency.
2. Since a thrust bearing is used between the rotor and the end plate, any possible burning of some component parts of the improved rotary compressor can be avoided.
3. Since it is possible to avoid any possible leakage of the oil into the refrigerating cycle, the cycle efficiency can be increased.

According to the present invention, the rotary compressor is provided with means for minimizing any possible leakage of the coolant. This means is constituted by a dynamic sealing means arranged between the rotor and the end plate to prevent the flow of the coolant. By so doing, the volume efficiency can advantageously be increased.

BRIEF DESCRIPTION OF THE DRAWINGS

These and other objects and features of the present invention will become apparent from the following description taken in conjunction with preferred embodiments thereof with reference to the accompanying drawings, in which.

DETAILED DESCRIPTION OF THE INVENTION

Figure 3:
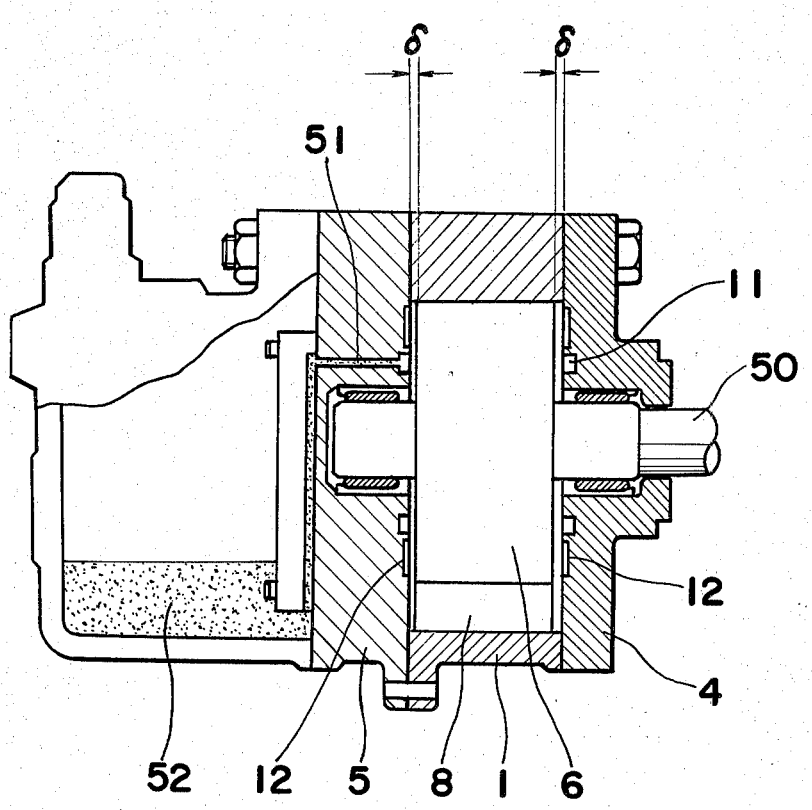
FIG. 3 is a side sectional view of a rotary compressor according to one preferred embodiment of the present invention.
Figure 4:
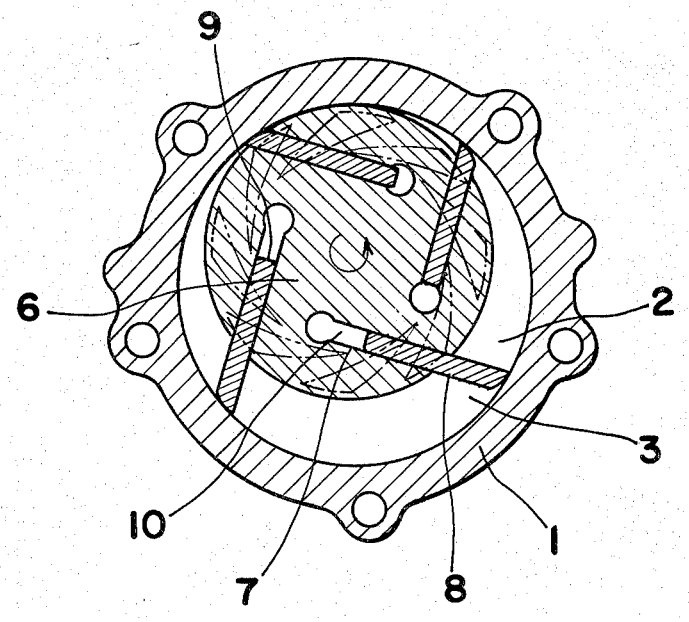
FIG. 4 is a cross-sectional view of the compressor shown in FIG. 3.
Figure 5:
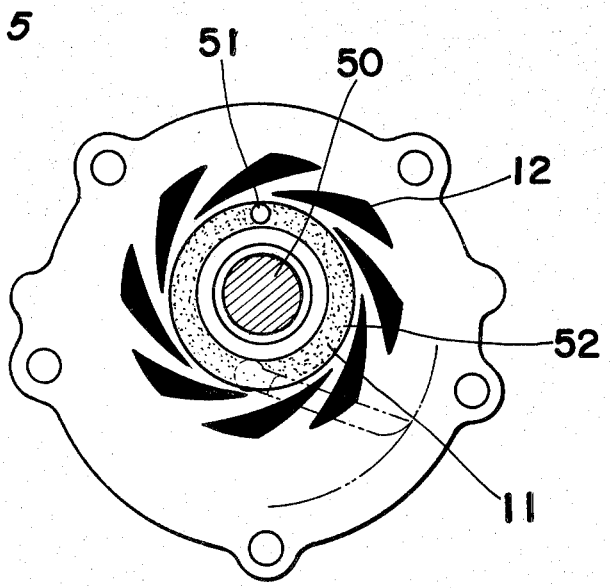
FIG. 5 is a plan view showing an end plate used in the compressor shown in FIG. 3.

Referring to FIGS. 3 to 5 showing a rotary compressor particularly suited for use in an automobile air-conditioner, the rotary compressor comprises a hollow cylinder 1 having a rotor 6 accommodated therein for eccentric rotation with respect to the longitudinal axis of the cylinder 1 and having its opposite ends closed by end plates 4 and 5 with the rotor 6 inside the cylinder 1. The rotor 6 carries a plurality of, for example, four, vanes 8 each being partially slidingly accommodated in a respective guide groove 7, said vanes 8 within the cylinder 1 dividing the interior of the cylinder 1 into four variable-volume vane chambers, the vane chambers under high and low pressures being designated by the reference numerals 2 and 3 respectively. Reference numeral 9 designates the respective rear ends of the vanes 8 which are positioned inside the associated guide grooves 7, said rear ends of the vanes 8 defining variable-volume spaces 10 in cooperation with the bottoms of the grooves 7, respectively. The spaces 10 in turn communicated to each other by means of a ring-shaped groove 11 defined on one surface of the end plate 5 adjacent the rotor 6 in coaxial relation to a shaft 50 fast with the rotor 6.

As can readily be understood by those skilled in the art, the volume of each of the spaces 10 varies cyclically as the rotor 6 undergoes an eccentric rotation with the tips of the respective vanes 8 held slidingly in contact with the interior wall surface of the cylinder 1. Accordingly, a fluid mixture of an oil with a gaseous coolant filled up in the spaces 10 periodically flows in and out of the spaces 10. However, since the volumes of the respective spaces 10 are variable and are different from each other at all time during the eccentrical rotation of the rotor 6, the fluid mixture is held in a state of equilibrium and flows in one space 10 and out of other spaces 10 through the ring-shaped groove 11. This ring-shaped groove 11 communicates through a connecting port 51 with a source 53 of the fluid mixture 52 of the oil with the gaseous coolant.

In order to provide a dynamic seal operable to minimize any possible leakage of the fluid mixture into any one of the vane chambers, spiral grooves 12 having spiral edges which converge in a radially inward direction are formed on the respective surfaces of the end plates 4 and 5 facing the rotor 6 in opposite directions with respect to each other and in coaxial relation to the longitudinal extent of the shaft 50. The diameter of the imaginary circle on which radially outer ends of the spiral grooves 12 are positioned is smaller than the diameter of the rotor 6 while the diameter of the imaginary circle on which radially inner ends of the spiral grooves 12 are positioned is larger than the outer diameter of the ring-shaped groove 11.

The rotary compressor of the construction described above is advantageous in the following respects.

(1) The volume efficiency can be increased markedly. By the provision of the dynamic seal between the respective surfaces of the rotor 6 and the end plate 4 or 5, any possible flow of the fluid mixture into any one of the vane chambers can be minimized or substantially eliminated.

The principle of operation of the dynamic seal is based on the principle of equilibrium between the generation of the load capacity resulting from a hydrodynamic effect (a wedge effect) at the gap surface and the force of closure given by the seal ring by the action of a closed fluid pressure.

It is to be noted that the spiral grooves employed in the illustrated embodiment involve not only the hydrodynamic effect, but also a pumping action by which the trapped fluid can be centripetally supplied. In other words, the function of the spiral grooves is essentially similar to that of the radial viscoseal, and the spiral grooves act in a manner similar to a screw pump of flat-plate type operable at a zero fluid flow against the head of the trapped fluid (it being noted that the fluid trapped in the ring-shaped groove 11 takes a value approximate to the discharge pressure of the compressor).

In the illustrated embodiment, the dynamic seal is featured in that it is formed so as to encircle the outer periphery of the ring-shaped groove 11 to which the fluid mixture is supplied for the purpose of stabilizing the reciprocal movement of each of the vanes 8. That is to say, the fluid mixture of the oil with the gaseous coolant has a viscosity higher than that of only the coolant and, therefore, the effect brought about by the dynamic seal is high.

The solubility of the coolant in the oil varies depending on the temperature and the pressure, and the apparent viscosity of the fluid mixture which is in effect a viscous fluid so varies, too. For example, when 5 to 30% of furonic gas (the coolant) is dissolved in the oil, the viscosity of the fluid mixture varies from 30 cst to 10 cst. This range of viscosity is, however, sufficient to form the dynamic seal.

It has long been known to those skilled in the art to employ a groove of relatively large depth on the surface of one or both of the end plates 4 and 5 or on the surface facing the adjacent end plates 4 and 5 for accommodating oil necessary to facilitate a smooth sliding movement of the rotor 6 in contact with the end plates 4 and 5.

However, in the present invention, the pattern of shallow groove, tens of microns in depth, formed by the use of a fine processing technique, for example, by the use of an etching technique, brings about a hydrodynamic effect resulting from a shear force of a wedge oil film, which results in formation of a pressure seal. This is quite different in nature from the oil groove employed in the prior art.

Various parameters of the spiral hydrodynamic seal used in the present invention are as follows.

TABLE 1

| Parameters | Symbol | Value used in Embodiment |
|---|---|---|
| Outer Radius | Ro | 31 mm |
| Inner Radius | Ri | 24 |
| Spiral Angle | $\alpha$ | 30° |
| Groove Depth | ho | 30$\mu$ |
| Gap Size | $\delta$ | 20$\mu$ |
| Number of Grooves | n | 8 |

(2) Any possible burning which would occur during a high speed rotation can be avoided.

Reasons for the burning of the sliding surface of the rotor 6 in the compressor are generally as follows.

(a) Reduction in size of the gap as a result of thermal expansion of the component parts 8, 1 and 6.

(b) Local thermal deformation resulting from uneven distribution of heat energies and (c) Fatigue of the lubricant oil.

In the present invention, however, a relatively large pressure is generated between the end face of the rotor 6 and the surface facing such end face of the rotor 6 by the hydrodynamic effect and, accordingly, the rotor 6 can be supported in its thrust direction.

The dynamic seal is similar to a hydrodynamic bearing in that the spring rigidity markedly increases with reduction in size of the gap between the end face of the rotor 6 and the surface facing such end face of the rotor 6.

In the prior art compressor, the fluid pressure developed between the end face of the rotor 6 and the surface facing such end face of the rotor 6 is generated only by the thermal wedge effect. Therefore, because of the reasons (a), (b) and (c) stated above, the metal-to-metal contact is likely to occur so often and, accordingly, there is a relatively great possibility of occurrence of burning. In view of this, the prior art is such that a relatively large gap is required between the end surface of the rotor and the surface facing such end surface of the rotor.

On the contrary thereto, in the present invention, because of the presence of the hydrodynamic effect of relatively large spring rigidity acting to maintain the gap uniformly, the gap of minimized size can be advantageously employed. In view of this, the present invention involves, in addition, to the advantage discussed under the item (1) above, such an additional advantage that not only can the gap be minimized, but leakage prevention can also be achieved with the increased resistance to fluid flow.

An essential feature of the present invention resides in that the dynamic seal is formed between the rotor 6 and each of the end plates 4 and 5.

In the present invention, the area where the dynamic seal serves concurrently as a thrust bearing is relatively large as compared with the thrust bearing of general outer radius. Therefore, even during a low speed rotation, a sufficient peripheral velocity can be achieved, accompanied by generation of a relatively large pressure, thereby minimizing the thermal deformation referred to in the item (2) above.

The hydrodynamic effect of the grooves formed in the manner as shown in FIG. 4 and the improved lubricating condition owing to the pumping effect occurs even in the hydrodynamic bearing.

Figure 6:
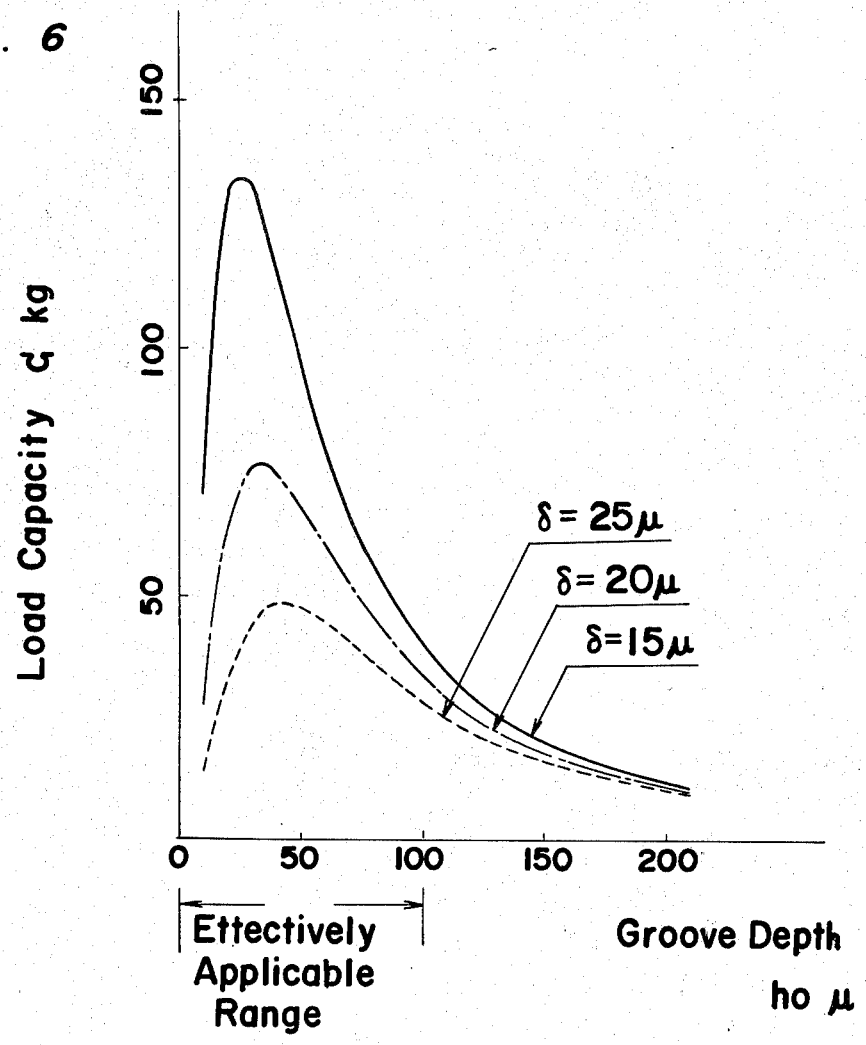
FIG. 6 is a graph showing the relationship between the load capacity and the groove depth.

FIG. 6 illustrate how the load capacity C of the spiral hydrodynamic seal varies with variation of the groove depth ho while the other parameters remain the same as shown in Table 1.

From the graph of FIG. 6, it is clear that when the groove depth ho is within the range of 5 to 100$\mu$, the spiral dynamic seal according to the present invention exhibits a practically applicable load capacity C. On the contrary, with the prior art grooves having a depth of at least hundreds micron and formed by a machine processing, no effect similar to that given by a thrust bearing effective to prevent the metal-to-metal contact of the rotor 6 to each of the end plates 4 and 5 can not be obtained.

In general, although similar effects can be achieved irrespective of whether the grooves serving as a fluid thrust bearing are formed on the sliding surface of the rotor 6 or on that of any one of the end plates 4 and 5, the present invention is featured in that the grooves for the dynamic seal are formed on each of the end plates 4 and 5, and, by so doing, any possible burning between the vanes 8 and the end plates 4 and 5 can be avoided.

Figure 7:
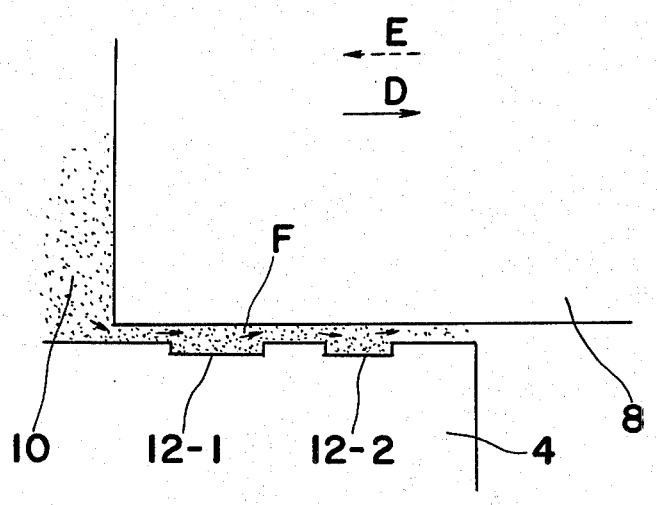
FIG. 7 is a diagram showing the relationship between each vane and the end plate.

FIG. 7 illustrates how the fluid mixture 52 flows through the gap between each vane 8 and each end plate 4 or 5. Reference numerals 12-1 and 12-2 represent respective sectional views of the neighboring spiral grooves 12 defined on the end plate 4, the arrow direction D represents the direction in which the vane 8 moves towards the projected position, and the arrow direction E represents the direction in which the vane 8 moves towards the retracted position.

Although the direction of flow of the fluid mixture, shown by the arrow F conforms to the direction D, in both cases, since the gap between the rotor 6 and the end plate 4 is stepped, a load capacity sufficient to avoid the metal-to-metal contact of the vanes 8 to any one of the end plates 4 and 5 can be obtained by the wedge effect.

In the foregoing description, the rotary compressor embodying the present invention has been described as used in an automobile air-conditioner. However, when used in a refrigerating cycle, the same rotary compressor can give, in addition to those advantages and effects hereinbefore described, the additional advantage of improving the refrigerating capacity because any possible leakage of oil into the refrigerating cycle is prevented. This will now be discussed.

If the oil, the viscosity of which has been reduced under the influence of the elevated temperature, leaks into the vane chambers 2 and then into the refrigerating cycle, the refrigerating capacity will be lowered by the following reasons.

(i) The cooling surface of a condenser is covered by an oil film, thereby hampering heat transmission.

(ii) The oil mist lowers the refrigerating efficiency of the compressor.

(iii) Since the oil of high viscosity flows in fluid circuits, the flow resistance increases.

However, in the rotary compressor embodying the present invention, since the oil tending to flow from the ring-shaped groove 11 into any one of the vane chambers 2 and 3 is minimized by the effect of the hydrodynamic seal, any reduction of the refrigerating capacity resulting from the reasons (i), (ii) and (iii) above can advantageously be avoided. In addition, the coolant separator which has heretofore been required to have a relatively large recovering capacity because of the large amount of the oil leaked can be simple in construction and, consequently, inexpensive to manufacture.

Moreover, since the present invention is such that the intended oil leakage prevention can be achieved even when oil of low viscosity is employed, the resistance imposed by the viscous load on various movable parts of the compressor is minimized, and, therefore, the mechanical efficiency of the compressor can be increased.

In the foregoing embodiment, the hydrodynamic seal has been described as employed in the form of the spiral grooves 12. However, in the embodiments shown in FIGS. 8 and 9, Rayleigh wave steps and herringbone-shaped grooves, respectively are employed in place of the spiral grooves 12, respectively.

Figure 8:
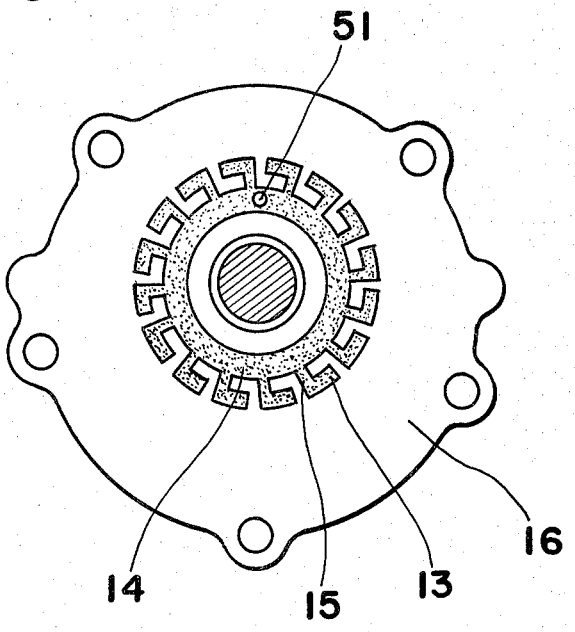
FIGS. 8 and 9 are views similar to FIG. 5, but showing other preferred embodiments of the present invention.

Referring first to FIG. 8, reference numeral 13 represents pocket areas of the Rayleigh wave steps, which communicate with the ring-shaped groove 14 through connecting passages 15. The only end plate is designated by reference numeral 16.

In this arrangement shown in FIG. 8, during the rotation of the rotor 6 relative to the end plate 16, the fluid mixture of the oil with the gaseous coolant is sucked from the groove 14 into the pocket areas 13 through the connecting passages 15. As the hydrodynamic effect increases, the fluid mixture so flowing into the pocket areas 13 is collected therein. Since each of the pocket areas 13 of relatively large capacity is surrounded by a narrow gap, a sufficient pressure can be retained. Where the hydrodynamic seal is employed in the form as shown in FIG. 8, there is no possibility of the oil being drawn from the perimeter of the rotor 6.

Figure 9:
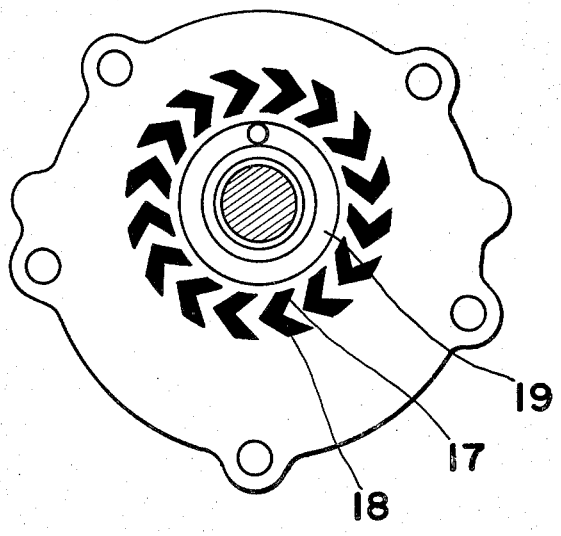

Referring now to FIG. 9, each of the herringbone-shaped grooves is composed of an inner spiral groove section 17 and an outer spiral groove section 18. The ring-shaped groove is indicated by reference numeral 19.

Figure 1:
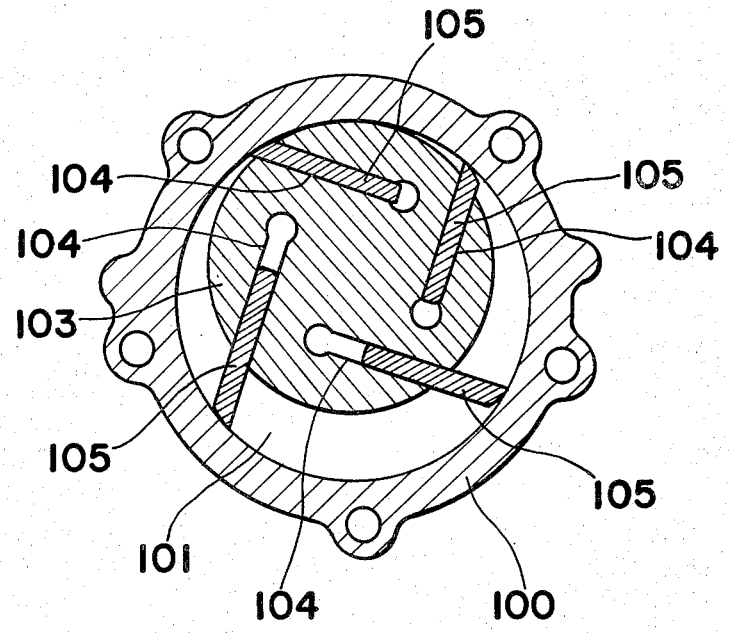
Fig. 1 Prior Art
FIG. 1 illustrates one prior art rotary compressor of a type utilizing sliding vanes, shown in cross-sectional view.
Figure 2:
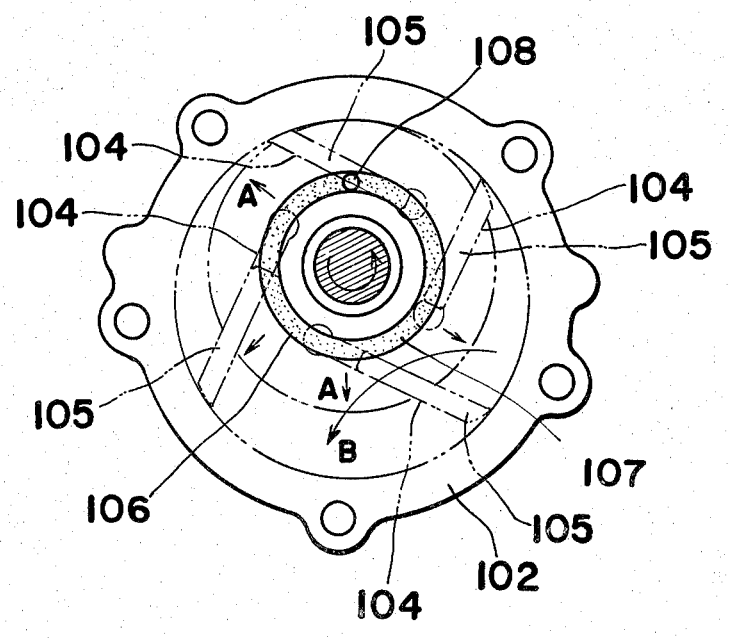
Fig. 2 Prior Art
FIG. 2 is a plan view showing an end plate used in the rotary compressor shown in FIG. 1.

The inner-spiral groove sections 17 are operable in a manner similar to that shown in FIG. 4 to cause the fluid to be supplied under pressure in the centrifugal direction whereas the outer spiral groove sections 18 are operable to cause the fluid to be supplied under pressure in the centripetal direction. Specifically, the outer spiral groove sections 18 bring about such an effect as to prevent the coolant from leaking from the high pressure cylinder chamber into the low pressure cylinder chamber in a manner as shown by the arrow B. Accordingly, by the arrangement shown in FIG. 9, any possible leakage of the coolant into the gap between the rotor and the end plate which would occur in both directions A and B shown in FIG. 2 can advantageously be eliminated.

The employment of the outer spiral groove sections 18 is effective to prevent the fluid leakage between the cylinder chambers even in the case of any one of the usual compressor and the pump wherein the ring-shaped groove such as employed in the present invention for stabilizing the movement of the vanes 8 is not employed.

On the other hand, the employment of the inner spiral groove sections 17 is effective to avoid any possible fluid leakage which has often occurred in the conventional compressor from one vane chamber into the next adjacent vane chamber. Accordingly, whether the herringbone-shaped grooves are to be employed or whether either one of the outer and inner spiral grooves are to be employed should be determined depending on the design of the rotary compressor. For example, in the case where the present invention is to be applied to the rotary compressor, the employment of such a groove arrangement effective to bring about the hydrodynamic effect on the sliding surfaces of the rotor or the surface on which the ring-shaped groove is formed is satisfactory.

Numerous advantages brought about by the present invention when applied to the rotary compressor utilizing the sliding vanes are listed as follows.

(A) By the effect of fluid leakage prevention, the volume efficiency can be increased.

(B) Because the rotor is supported by the hydrodynamic thrust bearing, any possible burning of some component parts which would occur by the effect of metal-to-metal contact during, for example, a high speed rotation can be avoided.

(C) Any possible leakage of the oil into the refrigerating cycle is minimized with the increased refrigerating efficiency.

(D) The mechanical loss can be minimized.

Although the present invention has fully been described in connection with the preferred embodiments thereof with reference to the accompanying drawings, it is to be noted that various changes and modifications are apparent to those skilled in the art. For example, although the present invention has been described as applied to the rotary compressor, the present invention can equally be applicable to any compressor of another type, a pump, a motor, a blower or an actuator.

Accordingly, such changes and modifications are to be understood as included within the true scope of the present invention unless they depart therefrom.

What is claimed is:

1. In a rotary compressor which comprises a rotor having end faces at opposite ends thereof, a hollow cylinder, end plates having opposite end surfaces respectively facing and closing opposite ends of the cylinder, the rotor being rotatably housed within the cylinder with its end faces in confronting spaced relation to the end surfaces of respective ones of the end plates to form respective gaps therebetween, one of one of the end surfaces and the corresponding facing end faces of the rotor having a first generally ring-shaped oil supply groove defined therein for containing oil and means for providing fluid communication between the first oil supply groove and an oil tank, the improvement comprising:

means, including a first arrangement of first patterned shallow grooves formed in at least one of the end surfaces or end faces at the end of the rotor having the first oil supply groove and located radially exteriorly of the first oil supply groove so as to encircle the first oil supply groove, for producing a hydrodynamic effect which produces a hydrodynamic seal between said one of said end surfaces and the corresponding end face of said rotor to maintain a uniform gap therebetween, when the rotor is rotated.

2. The improvement as in claim 1, wherein the rotor carries a plurality of sliding vanes supported for reciprocal movement in a radial direction of the rotor with the tips of said vanes held slidingly in contact with the interior wall of the cylinder and has guide grooves for partially accommodating the sliding vanes, and wherein the oil supply groove communicates with the guide grooves for applying a fluid pressure to one end of each of the sliding vanes opposite to its tip.

3. The improvement as in claim 2, wherein the depth of each of the first patterned groove of said first arrangement is no more than 100$\mu$.

4. The improvement as in claim 1, wherein said first arrangement of first patterned grooves is defined on one of said end surfaces of said end plates.

5. The improvement as in claim 4, wherein said first patterned grooves are in the shapes of Raleigh wave steps opening into the outer peripheral edge of the first oil supply groove.

6. The improvement as in claim 5, wherein the depth of each of the first patterned groove of said first arrangement is no more than 100$\mu$.

7. The improvement as in claim 1, further comprising a second oil supply groove defined in one of said end surfaces such that said first and second oil supply grooves are provided at opposite ends of the rotor, and a second arrangement of second patterned shallow grooves, formed in the end plate in which said second oil supply groove is formed radially exterior of said second oil supply groove so as to encircle said second oil supply groove, so as to produce a hydrodynamic effect which produces a hydrodynamic seal between the rotor and the end plate in which said second oil supply groove is formed, when the rotor is rotated.

8. The improvement as in claim 7, wherein the first and second patterned grooves of said first and second arrangements are respectively radially spaced from said first and second oil supply grooves and each patterned groove of said first and second patterned grooves has spiral edges which converge in a radially inward direction, so as to cause fluid to be supplied under pressure in a centripetal direction during rotation of the rotor.

9. The improvement as in claim 7, wherein the depth of each of the first patterned groove of said first arrangement is no more than 100$\mu$.

10. The improvement as in claim 1, wherein the gap between the end surfaces and the end faces are no more than 25$\mu$ wide.

11. The improvement defined in claim 1, wherein said first arrangement of first patterned grooves is radially spaced from said first oil supply groove.

12. The improvement as in claim 11, wherein said first patterned grooves of said first arrangement are herring-bone-shaped grooves.

13. The improvement as in claim 12, wherein the depth of each of the first patterned groove of said first arrangement is no more than 100$\mu$.

14. The improvement as in claim 1, wherein the depth of each of the first patterned groove of said first arrangement is no more than 100$\mu$.

15. The improvement as in claim 1, wherein the first patterned grooves of said first arrangement are shaped such as to cause a fluid to be supplied under pressure in a centripetal direction during the rotation of the rotor.

16. The improvement as in claim 15, wherein each of said first patterned grooves has a radially outwardmost edge portion, and a radially inwardmost edge portion radially inwardly of said radially outwardmost edge portion, along the boundaries of said each of said first patterned grooves, said radially outwardmost edge portions of said first patterned grooves and said radially inwardmost edge portions of said first patterned grooves being located along circles having radii respectively less than the radius of the rotor and greater than the outer radius of the first oil supply groove.

17. The improvement as in claim 15, wherein the depth of each of the first patterned grooves of said first arrangement is no more that 100$\mu$.

18. The improvement as in claim 15, wherein each of said first patterned grooves have two spiral edges which converge in a radially inward direction.

19. The improvement as in claim 18, wherein the depth of each of the first patterned groove of said first arrangement is no more than 100$\mu$.

20. The improvement as in claim 18, wherein said two spiral edges converge at a point outside the first oil supply groove, said two spiral edges of each of said first patterned grooves terminating at an outside edge lying on a same circle having a radius less than the radius of the rotor.

* * * * *